US007367445B2

(12) United States Patent
Mazurek

(10) Patent No.: US 7,367,445 B2
(45) Date of Patent: May 6, 2008

(54) HORIZONTAL RATCHETING CASE FEEDER MECHANISM

(76) Inventor: Mark Stanley Mazurek, 145 W. Hattendorf Ave., Roselle, IL (US) 60172

( * ) Notice: Subject to any disclaimer, the term of this patent is extended or adjusted under 35 U.S.C. 154(b) by 429 days.

(21) Appl. No.: 11/162,928

(22) Filed: Sep. 28, 2005

(65) Prior Publication Data

US 2007/0069455 A1 Mar. 29, 2007

(51) Int. Cl.
*B65G 25/00* (2006.01)

(52) U.S. Cl. ..... 198/777; 198/773; 198/746

(58) Field of Classification Search ..... 198/737, 198/738, 741, 745, 774.1, 746, 747, 777, 198/773; 414/794.7, 198; 53/252
See application file for complete search history.

(56) References Cited

U.S. PATENT DOCUMENTS 1,466,018 A * 8/1923 Hepburn ..... 198/741
2,029,125 A * 1/1936 Russell et al. ..... 198/741
2,161,124 A 6/1939 Babitz
3,322,301 A 5/1967 Bliss
3,598,399 A 8/1971 Cottrell
3,807,550 A 4/1974 Taylor
3,881,718 A 5/1975 Fernandez-Rana et al.
3,915,338 A 10/1975 Kronseder et al.
4,045,941 A * 9/1977 Flantua ..... 53/252
4,273,322 A 6/1981 Ginther, Sr. et al.
4,323,152 A * 4/1982 Wiknich ..... 198/774.1
4,697,973 A 10/1987 Hahn et al.
4,708,568 A 11/1987 Odorici
4,917,663 A 4/1990 Pazdernik
4,919,589 A 4/1990 Krappitz et al.
4,928,942 A 5/1990 Aiuola et al.
4,934,682 A 6/1990 Rece et al.
5,116,303 A 5/1992 Dietrich et al.
5,131,899 A 7/1992 Nagahashi et al.
5,190,278 A 3/1993 Wallin et al.
5,211,529 A 5/1993 Esala et al.
5,310,043 A 5/1994 Alcorn
5,320,212 A 6/1994 McIntosh et al.
5,320,213 A 6/1994 McIntosh et al.
5,352,178 A 10/1994 Pazdernik
5,653,671 A 8/1997 Reuteler
6,203,004 B1 3/2001 Spatafora et al.
2001/0007847 A1 7/2001 Greenwell
2002/0000690 A1 1/2002 Focke et al.
2002/0195316 A1 12/2002 Bertuzzi et al.

* cited by examiner

*Primary Examiner*—James R Bidwell

(57) ABSTRACT

A case feeder mechanism, used in quantities of two or more in a horizontal magazine, feeds cases to a removal position at the discharge end of the magazine, for extracting and processing by a case erecting machine. Each mechanism has two U-shaped channels, a sliding ratchet pawl channel and a fixed ratchet pawl channel, each containing a row of ratchet pawls. Each sliding ratchet pawl channel pushes the ratchet pawls against the back of the case group, driving the group towards the removal position. Individual sensing valves determine when the lead case is in the removal position and control each sliding ratchet pawl channel independently. Each fixed ratchet pawl channel holds the ratchet pawls in position, supporting the case group during resetting of the sliding ratchet pawl channel. To reload, cases are simply inserted, preferably in bundles, behind the existing case group.

18 Claims, 6 Drawing Sheets

HORIZONTAL RATCHETING CASE FEEDER MECHANISM

BACKGROUND OF INVENTION

This invention relates generally to packaging machinery such as machinery for squaring or erecting cases, and more specifically to horizontal magazines or hoppers for feeding packaging blanks.

Packaging machines, case erectors in particular, often utilize horizontal magazines, which store a reserve or group of flattened cases. As the lead case of the group is removed into the machine for processing, the magazine's feeder apparatus moves the group of cases towards the removal position. This places the new lead case in position for removal. The feeder apparatus typically consists of a single plate, or other substantial structure, which is in contact with and applying pressure against the rearmost case of the group. These magazines tend to fall into two basic types, related to their reserve capacity.

The first type of magazine is typically referred to as the "standard equipment" magazine, which has a capacity of approximately one hundred cases. This magazine is usually a basic, low-cost unit powered by a stored energy type of drive, such as gravity or spring tension. This type of magazine is typically inclined, so that the cases tend to flow downhill. A crude temporary support means is provided to facilitate reloading.

The second type of magazine is typically referred to as the "extended capacity" magazine, capable of handling two hundred cases or more. This magazine is usually a costly and complex upgrade, powered by electricity, compressed air, or fluid power, and may also incorporate automated controls to simplify operation and reloading. This invention relates to embodiments of the first type of magazine, to which there are currently several disadvantages, such as those listed below.

Retracting the feeding apparatus is a manual operation, typically involving reaching over the magazine and applying considerable effort. This is strenuous and awkward for the operator. Additionally, retracting the feeding apparatus can disturb or upset the remaining cases in the magazine, causing them to slide out of the magazine and disrupt operation of the case erecting machine.

The temporary support means used to hold the group of cases while loading typically does not adequately feed the cases. This can cause erratic feeding and jamming of the case erecting machine while the magazine is being loaded.

There are typically side guide rails provided to guide the outer edges of the cases. When loading, the additional cases must be lifted over these side guide rails from a position alongside the magazine, creating an awkward and difficult maneuver for the operator. When the magazine is mounted in an inclined manner, sloping downward towards the removal position, loading is made even more difficult.

Most magazines must be adjustable to accommodate a wide range of case sizes. An attempt is made to size and position the feeder apparatus to accommodate the widely varying area of the flattened case. This leads to a compromise in the reliability of the feeder apparatus, relative to where a particular case size falls in the range of the magazine. The largest cases are often most poorly served.

Most designs use only a single driving and/or braking mechanism to control case feeding. The lead case position is sensed or detected at only one point (the center of the bottom edge typically), if it is at all. This permits a good deal of variance in the attitude of the lead case as it is driven into the removal position. It may sit skewed, at an angle from top to bottom, or side to side, or both.

As the magazine empties, the decreasing pressure on the lead case causes an inconsistency in the final stopped location, at the removal position of the magazine. Particularly in case erecting machines that use a rotary motion to remove and square-up the case, this affects the squareness of the delivered case.

OBJECTS AND ADVANTAGES

The primary object of this invention is to provide an improved mechanism for feeding cases into a case erecting machine.

Another object of this invention is to provide a case feeder mechanism that functions well when mounted on a horizontally-positioned magazine.

Another object of this invention is to provide a case feeder mechanism that allows the magazine to be easily loaded from the rear, in the direction the cases flow through the magazine.

Another object of this invention is to provide a case feeder mechanism that allows the magazine to be loaded simply by inserting additional cases, without moving or otherwise affecting the feeding apparatus.

Another object of this invention is to provide a case feeder mechanism that delivers cases from the smallest size to the largest with the same accuracy and consistency.

Another object of this invention is to provide a case feeder mechanism that senses the position of the lead case in several areas across the face, and independently applies pressure behind these areas accordingly.

A still further object of this invention is to provide a case feeder mechanism that is modular in design, allowing it to accommodate different magazine size ranges and designs.

Yet another object of this invention is to provide an effective, low cost alternative to the standard equipment case feeder mechanisms, offered by most case erector manufacturers, that embodies many of the features of the case feeder mechanisms used on more expensive extended capacity magazines.

Other objects and advantages of the present invention will become apparent from the following descriptions, taken in connection with the accompanying drawings, wherein, by way of illustration and example, an embodiment of the present invention is disclosed.

SUMMARY OF THE INVENTION

In accordance with the present invention, a case feeder mechanism, two or more of which are mounted within a case magazine, utilizes both fixed and movable means to alternately hold cases in, and ratchet cases into the delivery position of the case magazine.

BRIEF DESCRIPTION OF DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
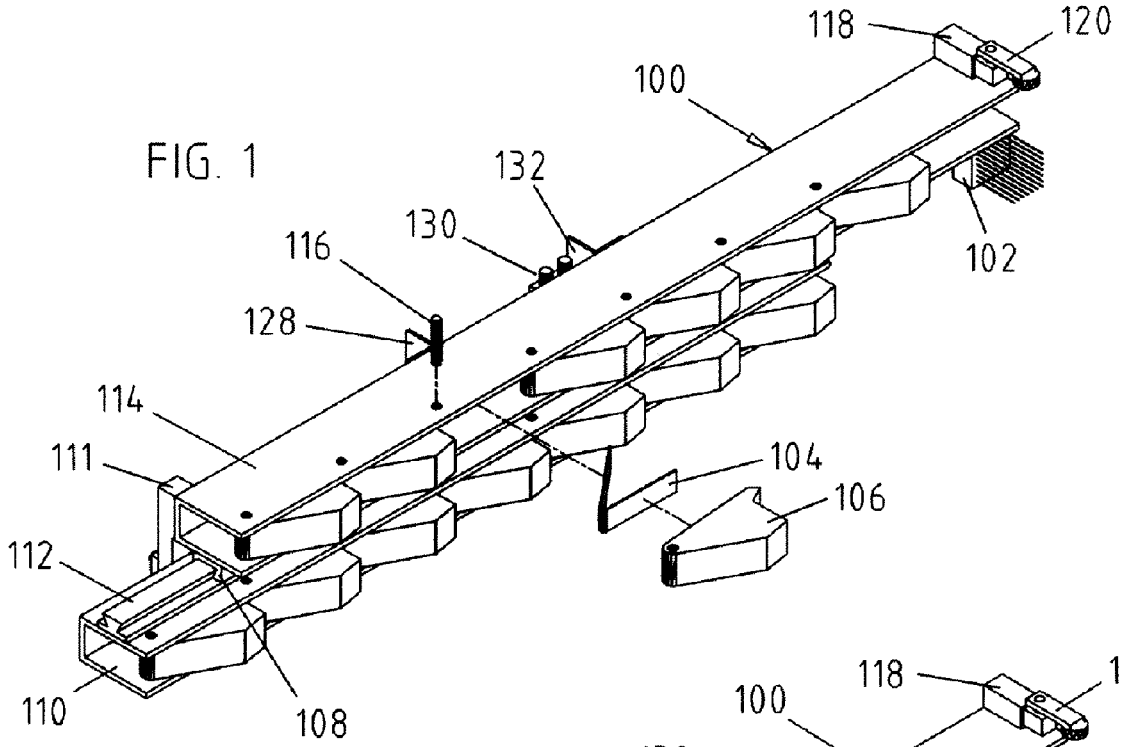
FIGS. 1, 1A, 2, and 2A are perspective views of the case feeder mechanism from two different angles and in two different states of operation.
Figure 1A:
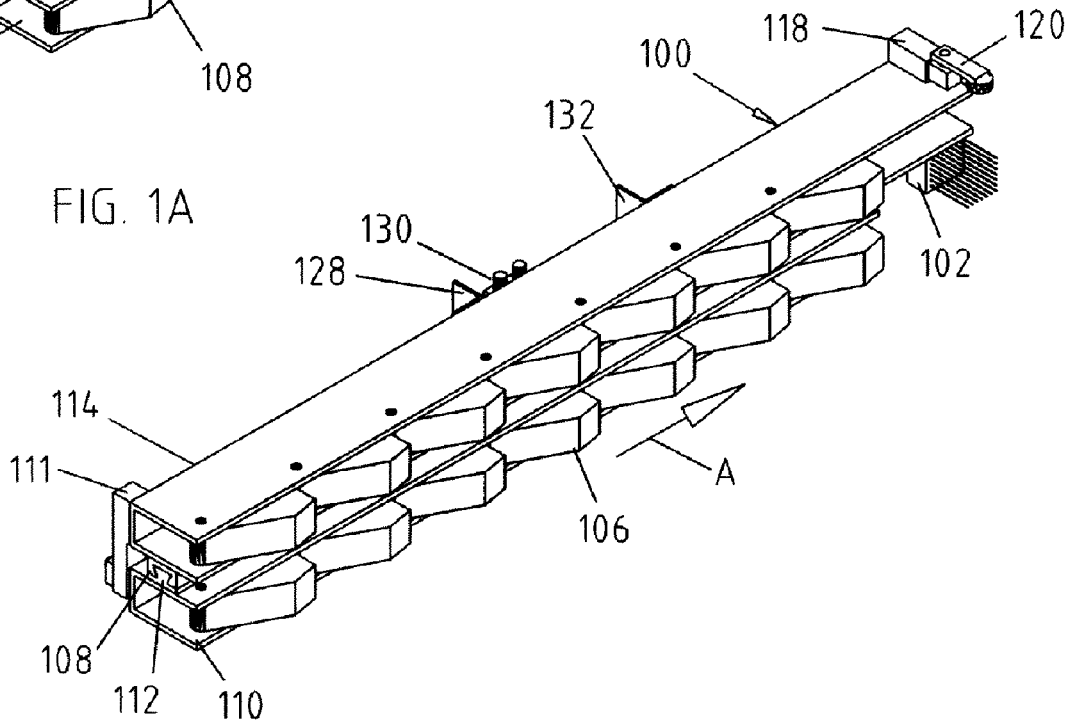
Figure 2:
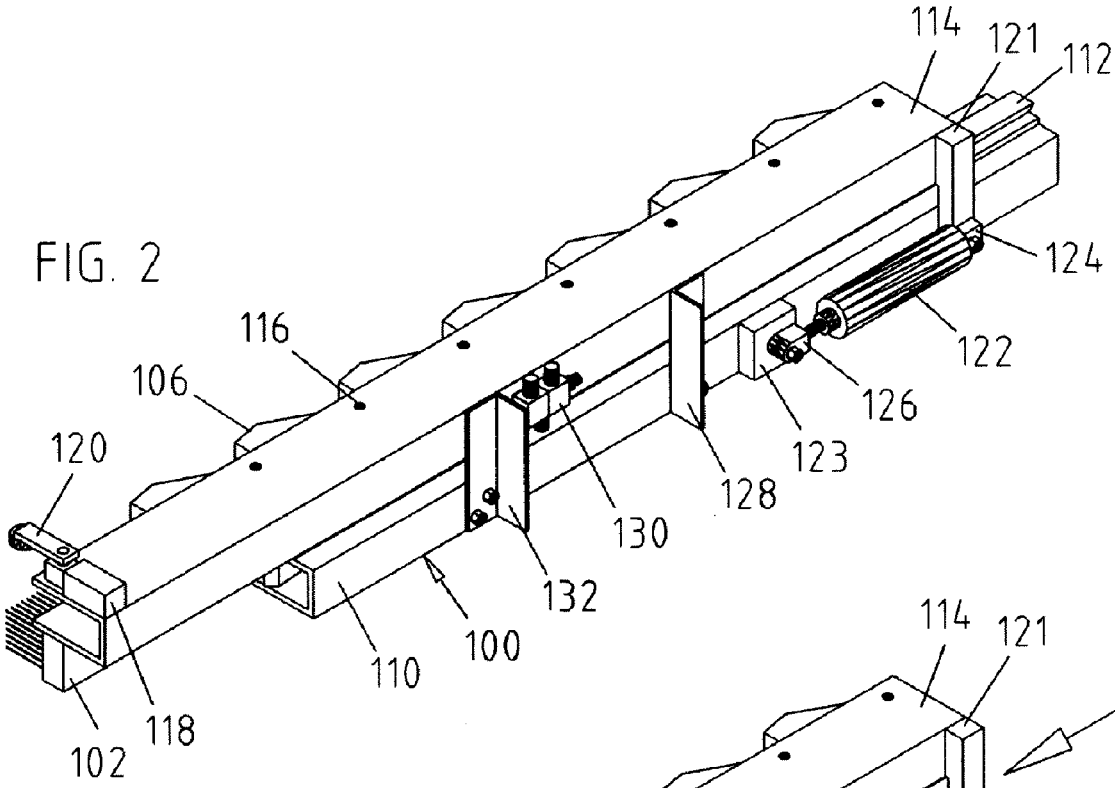
Figure 2A:
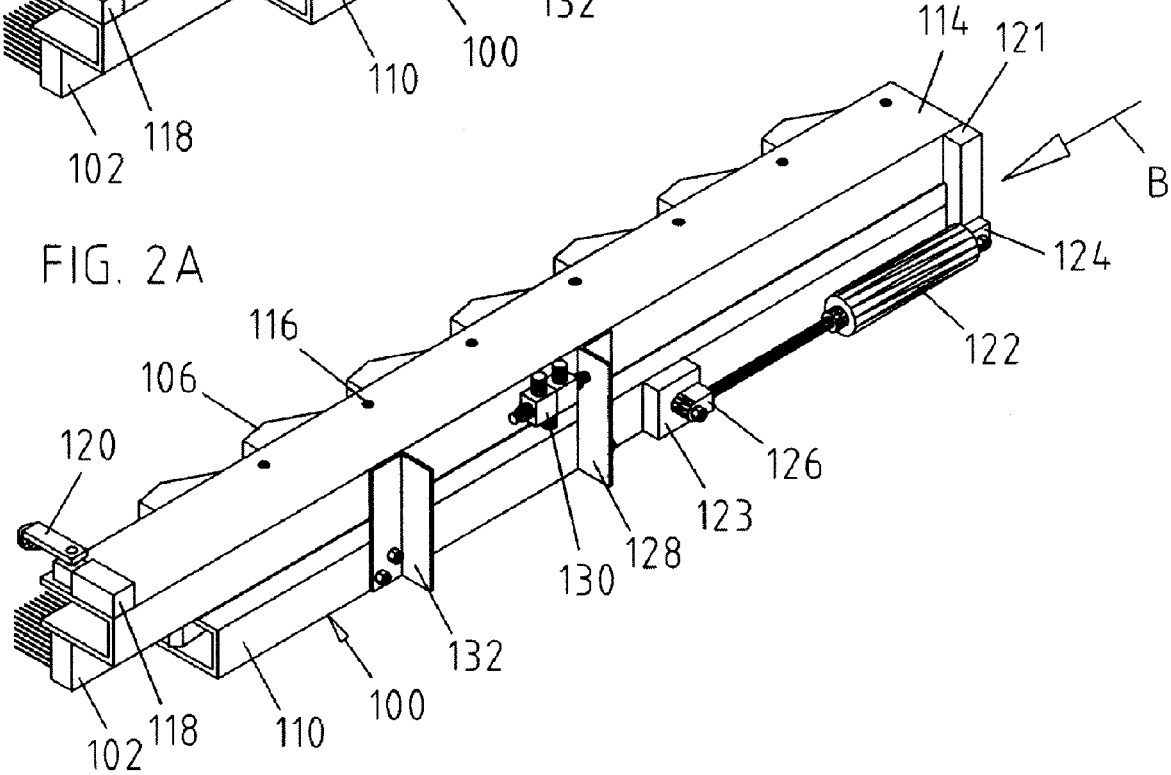

A preferred embodiment of a case feeder mechanism 100 is shown in FIGS. 1 through 2A. FIGS. 1 and 2 show opposite perspective views of the mechanism 100 in the fed-forward position, and FIGS. 1A and 2A show opposite perspective views of the mechanism 100 in the reset position.

The mechanism 100 includes various components which are well known to one of skill in the art. For example, the pneumatic cylinder 122 typically comprises a stationary cylinder body having a port at each end of its ends. The cylinder body clevis 124 is an integral part of the body of the cylinder and represents the mounting point by which the stationary cylinder body is attached. A movable rod passes longitudinally through the end seals of the body and a piston is fixed to the rod within the body. The cylinder rod clevis 126 is fastened to the rod of the cylinder and represents the mounting point by which the movable cylinder rod is attached. The piston has opposing surfaces which are acted upon by compressed air applied through the ports in the body. Depending on the differential of the pneumatic pressure applied to the ports, the piston is forced to slide within the body in a selected direction. The surface of the piston to which the rod is attached has a lesser amount of effective area which can be acted upon by the compressed air. Thus, if equal pneumatic pressures are applied to both ports, the piston will be forced towards the rod end of the cylinder. The degree of force thus applied to the piston is a fraction of that which would be exerted if only one port were to have the same pressure applied.

Valves are utilized, which are also well known to one of skill in the art. Such valves are pneumatic or air pressure control valves which direct or divert the flow of compressed air. These valves, which typically have two operating positions, are actuated or triggered either by physical contact with a moving mechanical component, or by application of compressed air to a particular port of the valve. Examples of such valves would be the case travel limit valve 118, the feeder direction valve 130, the reload valve 144, the flow control valve 142, and the shuttle valve 140, which are explained further in the following description.

Linear bearings are utilized, which are also well known to one of skill in the art. Such linear bearings consist of a fixed linear bearing rail 112 and one or more movable bearings or load carriers 108, which are mechanically interlocked with the rail 112. The bearings 108 can travel along the rail 112 carrying their load to and fro, while being maintained in a precise physical relationship with the rail 112.

As shown in FIG. 1, two bearings 108 are attached to a fixed ratchet pawl channel 114, and the rail 112 is attached to a sliding ratchet pawl channel 110. Channels 114 and 110 might be formed by bending sheet steel into a "U" shape. The sliding channel 110 can travel to and fro parallel to the fixed channel 114, in the direction illustrated by arrows A and B in FIGS. 1 through 2A.

As shown in FIGS. 1 and 1A, the fixed channel 114 and the sliding channel 110 each contain or carry an array of longitudinally spaced apart ratchet pawls 106, arranged in rows within the channels 114 and 110. The pawls 106 might be manufactured by injecting molten plastic into a mold designed to create the illustrated shape. The pawls 106 are rotatably attached to the channels 114 and 110 by ratchet pawl pivot pins 116, which pass through a hole in the narrow end of each pawl 106. The pawls 106 are able to pivot into and out of the channels 14 and 110 about the axis of the pins 116. Ratchet pawl springs 104 are attached to the interior vertical surfaces of each of the pawls 106, and are compressed between the interior vertical surface of the channels 114 and 110 and the pawls 106. The springs 104 urge the pawls 106 into a position extending from the channels 114 and 110. The lobe or tang on the end of each pawl 106, opposite the end with the hole for the pin 116, rests on the adjacent pawl 106, limiting the outward travel of each pawl 106.

Figure 3:
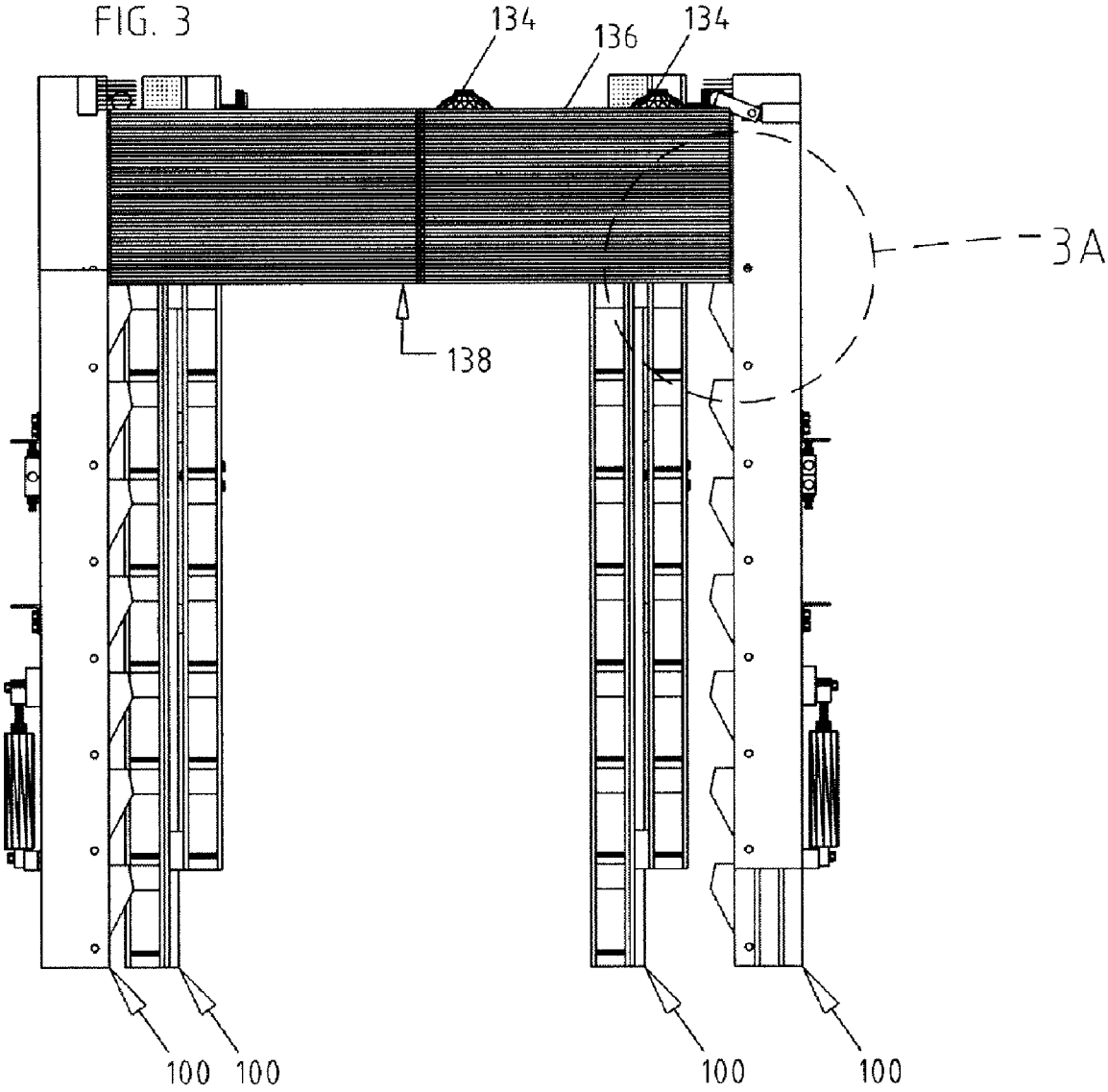
FIG. 3 is a plan view of four case feeder mechanisms containing and feeding a group of cases.
Figure 3A:
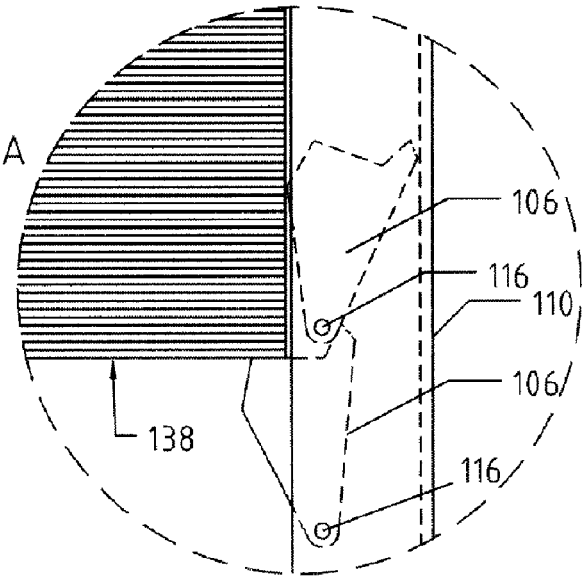
FIG. 3A is an enlarged view of a portion of FIG. 3.

An example of the two working positions of the pawls 106 is shown in FIG. 3A. The pawls 106 shown in the lower position are being extended from the sliding channel 110 and the fixed channel 114 by the springs 104 (shown in FIG. 1). These pawls 106 have the lobes or tangs resting against the lower ends of the pawls 106 shown in the upper position. These pawls 106 are in contact with the back of the case group 138. The pawls 106 shown in the upper position are being held inside the sliding channel 110 and the fixed channel 114 by the case group 138.

As shown in FIGS. 1 through 2A, the valve 118 is attached to the top surface of the fixed channel 114 at the case delivery end of the mechanism 100. A valve arm 120 is attached to the valve 118. As the lead case 136 moves into the delivery position, the arm 120 is contacted and rotated, actuating the valve 118. Thus, the valve 118 senses the presence of the lead case 136, the delivery or arrival position. A case retaining brush 102, which entraps and retains the lead case 136, is attached to the bottom surface of channel 114, at the case delivery end of the mechanism 100.

As shown in FIGS. 2 and 2A, a cylinder mounting bracket 121 is fastened to the channel 114, and a cylinder rod connecting bracket 123 is fastened to the channel 110. The cylinder 122 is attached via a clevis 124 to the cylinder mounting bracket 121, and via a clevis 126 to the cylinder rod connecting bracket 123. The valve 130 is attached to the exterior vertical surface of channel 114. A reset mode valve tripper 128, and a feed mode valve tripper 132 are attached to the exterior vertical surface of channel 110.

The mechanism 100 is designed such that the points of attachment are on the side or top exterior surfaces of the channel 114, which must remain stationary as the mechanism 100 operates. Two to four mechanisms 100 would typically be attached to an adjustable horizontal magazine of known construction (not shown in the drawings). The attachment might be by bolts or weldments to various adjustment mechanisms, which are well known to one of skill in the art, in a manner that allows for vertical and/or horizontal adjustment.

Figure 4:
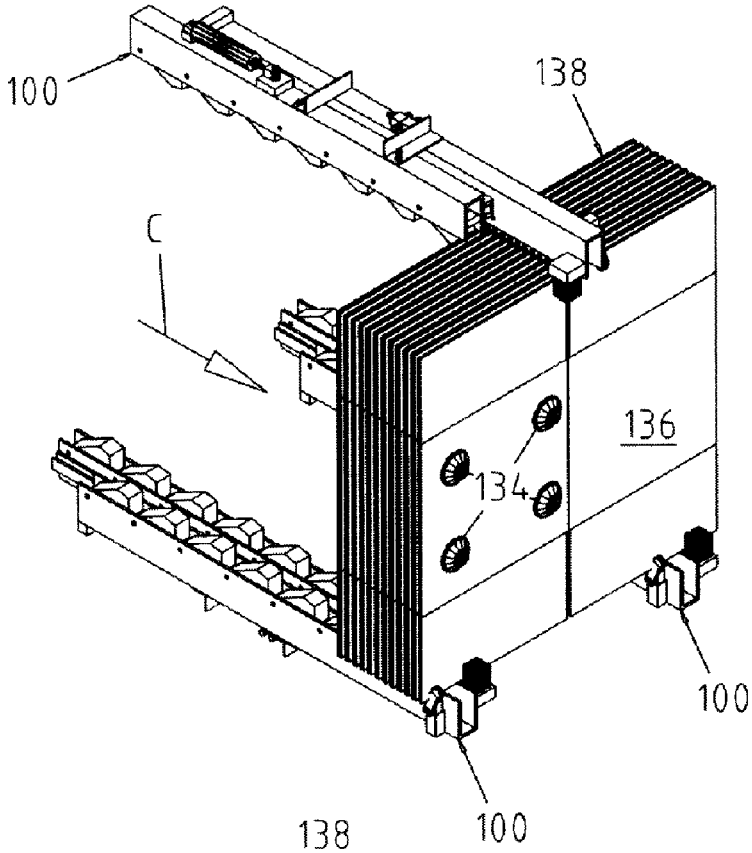
FIGS. 4 and 4A are perspective views of three case feeder mechanisms containing and feeding a group of cases.
Figure 4A:
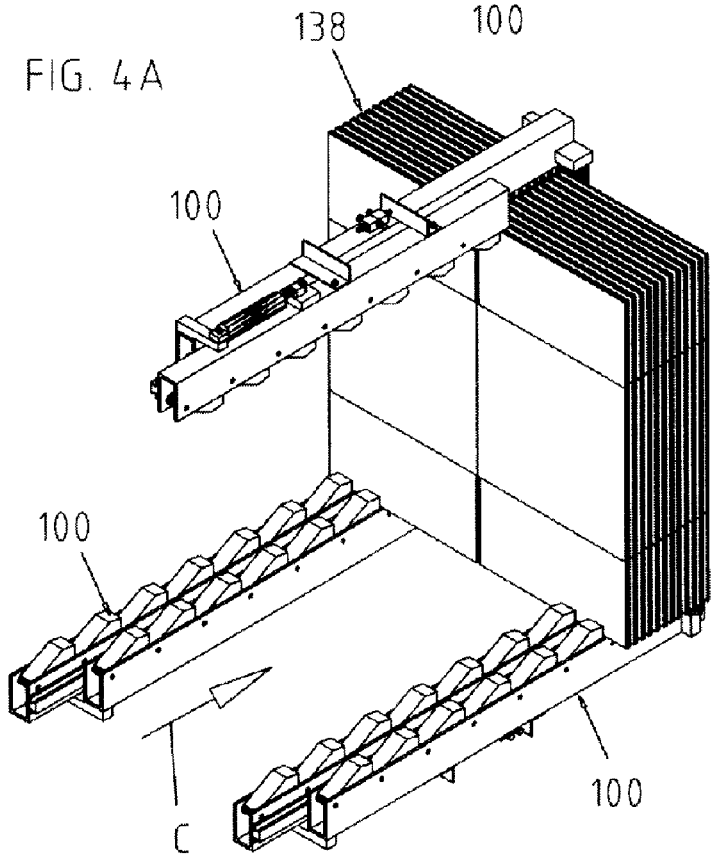
Figure 5:
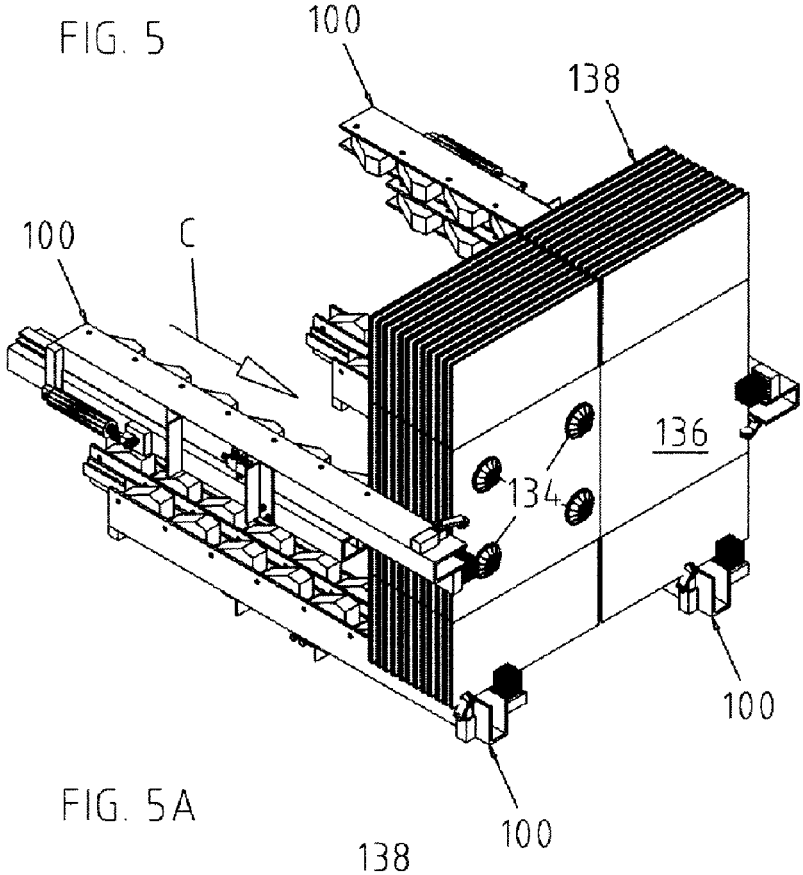
FIGS. 5 and 5A are perspective views of four case feeder mechanisms containing and feeding a group of cases.
Figure 5A:
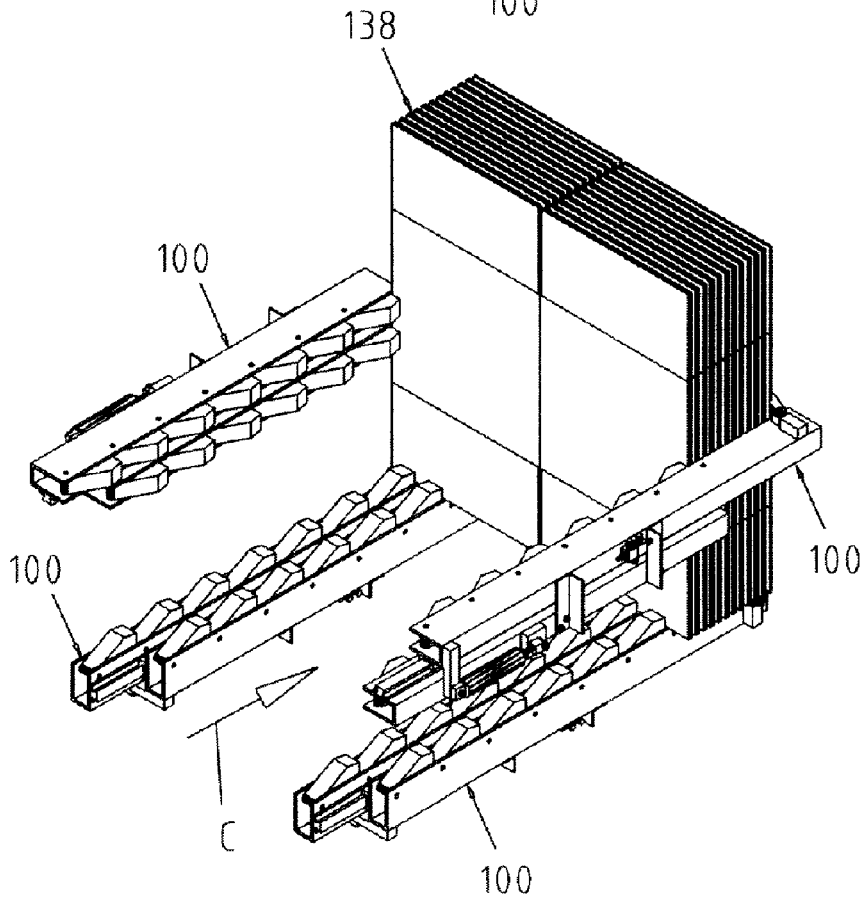

Two examples of possible applications for the mechanism 100 are illustrated by FIGS. 4 through 5A. In the first example shown in FIGS. 4 and 4A, three mechanisms 100 are shown held in position by an adjustable horizontal magazine of known construction, (not shown in the drawings). Surrounded by the three case feeder mechanisms 100 is the blank or case group 138. The lead case 136 of the group 138 has been driven into position for removal. The vertical face of the lead case 136 is pressed against the suction cups 134, which are part of a case erecting machine of known construction (not shown in the drawings). The cups 134 grasp and remove the lead case 136 from the magazine into the erecting machine for processing. FIGS. 5 and 5A show a similar possible configuration utilizing four mechanisms 100. Each mechanism 100 operates independently to control the delivery position of an area or zone of the lead case 136.

Figure 6:
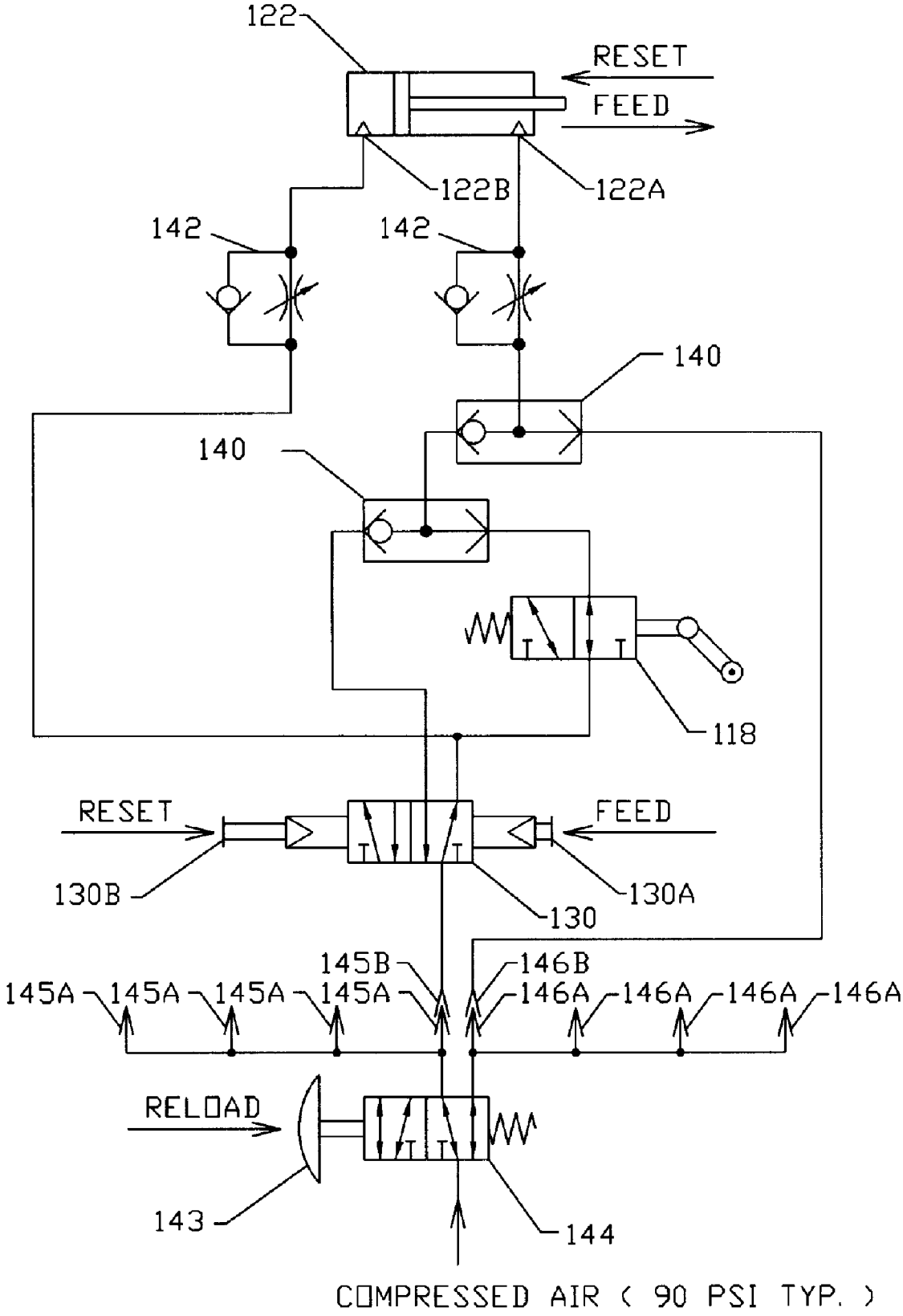
FIG. 6 is a pneumatic schematic of the case feeder mechanism controls.

FIG. 6 is a pneumatic schematic of the box feeder mechanism controls, wherein each of the valves mentioned earlier is illustrated. The control system is fed by and operates from compressed air delivered at a pressure of 90 psi, or pounds-per-square-inch, sources of which are very common to industrial environments. Plastic tubing and related fittings, well known to one of skill in the art, are used to connect the pneumatic components.

The reload valve 144 is a mechanically actuated, spring returned valve. The valve 144 is shown held in the initial or at-rest position by spring pressure, wherein air flow is allowed from the inlet port to the first outlet port, and the second outlet port is open to atmosphere. The valve 144 changes positions as the pushbutton 143 is manually depressed against spring pressure. In the actuated position, the valve 144 allows air flow from the inlet port to the second outlet port, and the first outlet port is open to atmosphere. As the pushbutton 143 is released, spring pressure returns the valve 144 to the at-rest position.

The feeder direction valve 130 is a mechanically actuated valve which utilizes a detent mechanism to hold the current position. The valve 130 changes to the feed position as the pushbutton 130A is depressed, and to the reset position as the pushbutton 130B is depressed. The valve 130 is shown in the feed position, wherein air flow is allowed from the inlet port to the first outlet port, and the second outlet port is open to atmosphere. In the reset position, the valve 130 allows air flow from the inlet port to the second outlet port, and the first outlet port is open to atmosphere.

The case travel limit valve 118 is a mechanically actuated, spring returned valve. The valve 118 changes positions as the valve arm 120 is rotated against spring pressure. The valve 118 is shown in the actuated position, allowing air flow from the inlet port to the outlet port. As the arm 120 is released, spring pressure returns the valve 118 to the at-rest position, wherein the inlet port is blocked, and the outlet port is open to atmosphere.

The shuttle valve 140 is actuated by air pressure to either or both of the two inlet ports. The valve 140 allows air flow from the inlet port having the highest positive pressure to the outlet port, while blocking the remaining inlet port. In this particular application, two valves 140 are connected in series, the output of the first valve 140 having been connected to an input port of the second valve 140. The net result of this configuration is that the highest of three possible sources of air pressure is allowed to flow to the outlet port of the second valve 140.

The flow control valve 142 consists of a combination of a check valve and a needle valve, connected parallel to each other. The check valve allows full air flow in one direction, and no air flow in the opposite direction, while the needle valve allows adjustably restricted air flow in either direction. The net result of this configuration is that the valve 142 allows full air flow in one direction, and adjustably restricted air flow in the opposite direction. The valve 142 is typically used to control the operating speed of an air cylinder, such as cylinder 122, by allowing full compressed air flow into a port, and adjustably restricted exhaust air flow out of the same port.

All of the components shown in FIG. 6 are mounted upon each mechanism 100, with the exception of the reload valve 144. The reload valve 144 is mounted on the magazine, within reach of a loading operator standing in position to load the magazine. Only one reload valve 144 is required per magazine, and controls all of the mechanisms 100 mounted upon the magazine. The reload valve 144 has attached to the outlet ports several of a connector 145A, and a connector 146A. Each mechanism 100 has a connector 146B attached to an inlet port of one of the shuttle valves 140, and a connector 145B attached to the inlet port of the feeder direction valve 130. As many mechanisms 100 as are required are connected to the reload valve 144, via connectors 145A through 146B.

Each of the mechanisms 100 shown in FIGS. 4 through 5A is illustrated in the at-rest condition. Each mechanism 100 operates independently of the others, in the manner described by the following.

The reload valve 144 is in the at-rest position, allowing compressed air flow to the inlet port of the feeder direction valve 130. The feeder direction valve 130 is in the feed position, allowing compressed air flow to the cylinder port 122B and the inlet port of the case travel limit valve 118. The case travel limit valve 118 is being held in the activated state via the valve arm 120, which is in contact with the current lead case 136. The case travel limit valve 118 allows compressed air flow to the shuttle valves 140 which, in turn, allow compressed air flow to the cylinder port 122A of the air cylinder 122. As a result, both ports 122A and 122B of the cylinder 122 are pressurized to 90 psi. As described earlier, this results in a reduced degree of force being applied to the piston of the cylinder 122 in the direction of the rod end. This in turn applies force to the sliding channel 110, and the attached row of pawls 106, in the feed direction. Thus, the position of the case group 138 is maintained by the ratchet pawl 106 within the sliding channel 110 that is currently in contact with and pressed against the rearmost case of the case group 138. This, in turn, keeps the adjacent area of the current lead case 136 in position for removal. The adjacent area of the current lead case 136 is held inside the magazine by case retaining brush 102, assisted by the valve arm 120.

As the suction cups 134 remove the current lead case 136 into the case erecting machine for processing, the valve arm 120 swings away from the case group 138 and clear of the lead case 136. The case retaining brush 102 holds back the adjacent area of the remaining case group 138. The valve arm 120 then retracts back against the new lead case 136, returning the case travel limit valve 118 to the at-rest position. The case travel limit valve 118 allows exhaust air flow from the cylinder port 122A to atmosphere. As 90 psi applied to the cylinder port 122B, the air cylinder 122 applies maximum force to the sliding channel 110, which is driven towards the discharge end of the magazine as illustrated by arrows A, B, and C. This in turn drives the ratchet pawl 106 that is currently in contact with the back side of case group 138 against the group, moving or ratcheting the adjacent area of the new lead case 136 into position for removal. The case travel limit valve 118 is actuated via the valve arm 120 by the new lead case 136. This again allows compressed air flow to the cylinder port 122A of the air cylinder 122. The mechanism 100 is again in an at-rest condition, awaiting the removal of the current lead case 136

As the sliding channel 110 moves, the amount of one case thickness at a time, towards the discharge end of the magazine, the air cylinder 122 approaches the fully extended position, illustrated in FIGS. 2 and 4. This initiates the resetting process of the case feeder mechanism 100. The pawl 106, contained in the fixed channel 114, that is nearest the rearmost case of the case group 138 is cleared by the group and returned to the extended position. This particular pawl 106 moves from the position illustrated by the upper pawl 106 show in FIG. 3A, to the position illustrated by the lower pawl 106. This pawl 106 will support, and hold the position of, the adjacent area of the case group 138 during the resetting process.

The reset mode valve tripper 128 reaches and actuates the feeder direction valve 130, which is then shifted to the reset position, as shown in FIG. 6. The feeder direction valve 130 allows exhaust air flow from the cylinder port 122B to atmosphere, and compressed air flow to the cylinder port 122A, via the shuttle valves 140. The cylinder 122 then fully retracts, moving the sliding channel 110 to the reset position, illustrated in FIGS. 1 and 2. Simultaneously, the ratchet pawl 106, contained in the sliding channel 110, that is immediately nearest the rearmost case of the case group 138 is moved clear of the group and returned to the extended position. This particular ratchet pawl 106 moves from the position illustrated by the upper pawl 106 show in FIG. 3A, to the position illustrated by the lower pawl 106. This particular pawl 106 will resume driving the case group 138 after the resetting process is completed.

As the air cylinder 122 reaches the fully retracted position, the feed mode valve tripper 132 reaches and actuates the feeder direction valve 130, which is then shifted back to the feed position, as shown in FIG. 6. The case feeder mechanism 100 can now resume the process of feeding boxes, as described above.

As the case group 138 becomes depleted, reloading becomes necessary. Groups of flattened cases, preferably strapped into bundles, are inserted into the area surrounded by the three case feeder mechanisms 100, in the direction of the arrows C, as shown in FIGS. 4 through 5A. The loading operator pushes the fresh group of cases in the feed direction until the cases are near the back of the case group 138. The loading operator then depresses the pushbutton 143 of the reload valve 144. The reload valve 144 allows compressed air flow to the inlet ports of the shuttle valves 140 of all of the mechanisms 100 simultaneously, which, in turn, allow compressed air flow to the cylinder ports 122A of the air cylinders 122. The reload valve 144 also allows exhaust air flow from the inlet ports of the feeder direction valves 130. The cylinders 122 then fully retract, simultaneously resetting all of the mechanisms 100, in the manner described earlier. When all of the mechanisms 100 are reset, the operator then releases the pushbutton 143 of the reload valve 144, allowing the mechanisms 100 to return to the feed mode of operation. As the mechanisms 100 resume cycling, the additional group of cases is then driven into the case group 138, marrying the two groups together into the new case group 138.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A mechanism for feeding packaging blanks, such as flattened cases, from a horizontal magazine into a packaging machine comprising:

a fixed ratchet pawl channel;

a plurality of longitudinally spaced apart ratchet pawls, each pivotally mounted in a row within said fixed ratchet pawl channel;

a sliding ratchet pawl channel;

a plurality of longitudinally spaced apart ratchet pawls, each pivotally mounted in a row within said sliding ratchet pawl channel;

means for urging said ratchet pawls to maintain a position extended from said ratchet pawl channels;

means for slidably attaching said sliding ratchet pawl channel parallel to said fixed ratchet pawl channel;

means for slidably driving said sliding ratchet pawl channel to and fro a predetermined distance approximately equivalent to the length of said ratchet pawl, in relation to said fixed ratchet pawl channel;

means for controlling said driving means; and means for retaining boxes in the magazine at the removal end of the mechanism;

whereby one edge of the rearmost packaging blank of a group of packaging blanks contained within said magazine is engaged by one of said ratchet pawls from said sliding ratchet pawl channel, driving said group towards the delivery end of said magazine and actuating said means for controlling said driving means, until said driving means travels a distance equivalent to the length of said ratchet pawl, at which point one of said ratchet pawls from said fixed ratchet pawl channel engages said rearmost blank, supporting said group while said controlling means retracts, and consequently resets, said sliding pawl channel.

2. The mechanism for feeding packaging blanks as claimed in claim 1 wherein said means for urging said ratchet pawls to maintain a position extended from said ratchet pawl channels comprises springs.

3. The mechanism for feeding packaging blanks as claimed in claim 1 wherein said means for slidably attaching said sliding ratchet pawl channel parallel to said fixed ratchet pawl channel comprises linear bearings and a linear bearing guide rail.

4. The mechanism for feeding packaging blanks as claimed in claim 1 wherein said means for slidably driving said sliding ratchet pawl channel in relation to said fixed ratchet pawl channel comprises a pneumatic cylinder powered by compressed air.

5. The mechanism for feeding packaging blanks as claimed in claim 1 wherein said means for controlling said driving means comprises a case travel limit valve, a feeder direction valve, a reload valve, and two shuttle valves.

6. The mechanism for feeding packaging blanks as claimed in claim 1 wherein said means for retaining cases at the removal end of the mechanism comprises a case retaining brush.

7. A method for feeding packaging blanks, such as flattened cases, from a horizontal magazine into a packaging machine, the magazine having a minimum of two horizontal ratcheting case feeder mechanisms mounted within, each mechanism having a fixed ratchet pawl channel and a sliding ratchet pawl channel, each channel having a plurality of longitudinally spaced apart pivotally mounted spring loaded ratchet pawls, said method comprising the steps of:

providing a group of packaging blanks within said magazine, said blanks being arranged perpendicular to the feed direction such that each flat side faces the flat side of an adjacent blank;

monitoring the position of the lead packaging blank of said group of packaging blanks on it's forward facing surface;

engaging a minimum of two areas adjacent to different edges of the rearmost packaging blank of said group of packaging blanks by one of said ratchet pawls from each of said sliding ratchet pawl channels;

driving said sliding ratchet pawl channels and consequently, said group of packaging blanks, towards the delivery end of said magazine;

controlling the driving means of said sliding ratchet pawl channels such that the said monitored position of said lead packaging blank is kept constant as said lead packaging blank is removed into said packaging machine and replaced by the next packaging blank in line;

engaging a minimum of two areas adjacent to different edges of the rearmost packaging blank of said group of packaging blanks by one of said ratchet pawls from each of said fixed ratchet pawl channels when the sliding ratchet pawl channels have traveled a distance approximately equivalent to the length of said ratchet pawl; and retracting, and consequently resetting, said sliding ratchet pawl channels.

8. The method for feeding packaging blanks as claimed in claim 7 wherein said step of monitoring the position of the lead packaging blank further comprises independently monitoring the position of the lead packaging blank of said group of packaging blanks on it's forward facing surface in areas corresponding to, and aligned with, said minimum two areas adjacent to different edges of the rearmost packaging blank.

9. The method for feeding packaging blanks as claimed in claim 7 wherein said step of driving said ratchet pawl channels further comprises independently driving said sliding ratchet pawl channels and consequently, said group of packaging blanks, towards the delivery end of said magazine.

10. The method for feeding packaging blanks as claimed in claim 7 wherein said step of controlling the driving means of said sliding ratchet pawl channels further comprises controlling the driving means of said sliding ratchet pawl channels such that the said monitored positions of said lead packaging blank areas are kept constant as said lead packaging blank is removed into said packaging machine and replaced by the next packaging blank in line.

11. An apparatus for feeding packaging blanks, such as flattened cases, from a horizontal magazine into a packaging machine comprising:

a group of packaging blanks within said magazine, said blanks being arranged perpendicular to the feed direction such that each flat side faces the flat side of an adjacent blank;

a minimum of two first rows of longitudinally spaced apart pivotally mounted ratchet pawls, said first rows being mounted to stationary members, said stationary members mounted within said magazine such that said first rows are positioned parallel to and alongside different sides of said group of packaging blanks;

a minimum of two second rows of longitudinally spaced apart pivotally mounted ratchet pawls, said second rows being mounted to movable members, said movable members being slidably mounted to and parallel with said stationary members;

means for urging said ratchet pawls to pivot towards said box group;

means for slidably driving said movable members to and fro a predetermined distance approximately equivalent to the length of said ratchet pawl, in relation to said stationary members;

means for controlling said driving means; and means for retaining boxes in the magazine at the removal end of the mechanism;

whereby the rearward-facing surface of the rearmost packaging blank of said group contained within said magazine is engaged by ratchet pawls from each of said movable members, driving said group towards the delivery end of said magazine and actuating said means for controlling said driving means, until said driving means travels a distance approximately equivalent to the length of said ratchet pawl, at which point one of said ratchet pawls from each of said stationary members engages said rearmost blank, supporting said group while said controlling means retracts, and consequently resets, said movable member.

12. An apparatus for feeding packaging blanks as claimed in claim 11 wherein said stationary members comprise fixed ratchet pawl channels.

13. An apparatus for feeding packaging blanks as claimed in claim 11 wherein said movable members comprise sliding ratchet pawl channels.

14. An apparatus for feeding packaging blanks as claimed in claim 11 wherein said means for urging said ratchet pawls to pivot towards said box group comprises springs.

15. An apparatus for feeding packaging blanks as claimed in claim 11 wherein said means for slidably attaching said movable members parallel to said stationary members comprises linear bearings and linear bearing guide rails.

16. An apparatus for feeding packaging blanks as claimed in claim 11 wherein said means for slidably driving said movable members in relation to said stationary members comprises pneumatic cylinders powered by compressed air.

17. An apparatus for feeding packaging blanks as claimed in claim 11 wherein said means for controlling said driving means comprises a case travel limit valve, a feeder direction valve, a reload valve, and two shuttle valves.

18. An apparatus for feeding packaging blanks as claimed in claim 11 wherein said means for retaining cases at the removal end of the mechanism comprises case retaining brushes.

* * * * *